US011492919B2

(12) United States Patent
Waki et al.

(10) Patent No.: US 11,492,919 B2
(45) Date of Patent: Nov. 8, 2022

(54) VANE SEGMENT AND STEAM TURBINE COMPRISING SAME

(71) Applicant: Mitsubishi Hitachi Power Systems, Ltd., Yokohama (JP)

(72) Inventors: Yuichiro Waki, Yokohama (JP); Shouhei Danno, Yokohama (JP); Yuki Yamamoto, Yokohama (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 74 days.

(21) Appl. No.: 16/495,496

(22) PCT Filed: Oct. 23, 2018

(86) PCT No.: PCT/JP2018/039330
§ 371 (c)(1),
(2) Date: Sep. 19, 2019

(87) PCT Pub. No.: WO2019/167336
PCT Pub. Date: Sep. 6, 2019

(65) Prior Publication Data

US 2020/0095878 A1 Mar. 26, 2020

(30) Foreign Application Priority Data

Mar. 1, 2018 (JP) ..... JP2018-036496

(51) Int. Cl.
*F01D 9/04* (2006.01)
*F01D 25/24* (2006.01)

(52) U.S. Cl.
CPC ..... *F01D 9/042* (2013.01); *F01D 9/041* (2013.01); *F01D 25/246* (2013.01); *F05D 2240/55* (2013.01); *F05D 2260/30* (2013.01)

(58) Field of Classification Search
CPC ..... F01D 9/00; F01D 9/02; F01D 9/04; F01D 9/041; F01D 9/042; F01D 5/3023;
(Continued)

(56) References Cited

U.S. PATENT DOCUMENTS 4,632,634 A 12/1986 Vinciguerra et al.
4,816,213 A 3/1989 Groenendaal, Jr.
(Continued)

FOREIGN PATENT DOCUMENTS

GB 191027483 A * 11/1911 ..... F01D 5/30
GB 760884 A * 11/1956 ..... F01D 9/042
(Continued)

OTHER PUBLICATIONS

International Search Report dated Jan. 8, 2019, issued in counterpart Application No. PCT/JP2018/039330, with English translation. (4 pages).
(Continued)

*Primary Examiner* — Eldon T Brockman
*Assistant Examiner* — Elton K Wong
(74) *Attorney, Agent, or Firm* — WHDA, LLP

(57) ABSTRACT

A vane segment includes a blade ring, a plurality of vanes, and a caulking member. The blade ring includes a blade ring groove and a storage space forming portion. The blade ring groove includes a convex portion projecting from a second groove side surface of the blade ring groove to the first side. The storage space forming portion, in combination with an outer shroud, forms a storage space into which the caulking member enters. The caulking member is accommodated within the storage space, contacts with the blade ring groove and the outer shroud, and is exposed from an inner opening of the storage space.

8 Claims, 8 Drawing Sheets

(58) Field of Classification Search
CPC ..... F01D 5/303; F01D 5/3038; F01D 25/24; F05D 2230/60; F05D 2240/55; F05D 2260/30
See application file for complete search history.

(56) References Cited

U.S. PATENT DOCUMENTS

| | | | | |
|---|---|---|---|---|
| 4,819,313 | A | 4/1989 | Dadhich | |
| 4,900,223 | A * | 2/1990 | Groenendaal, Jr. ..... | F01D 9/04 415/190 |
| 8,167,548 | B2 | 5/2012 | Greim et al. | |
| 9,316,107 | B2 | 4/2016 | Megerle et al. | |
| 2004/0253095 | A1 * | 12/2004 | Sasaki ..... | F01D 9/042 415/191 |
| 2010/0232934 | A1 | 9/2010 | Burdgick et al. | |
| 2011/0103943 | A1 | 5/2011 | Kupper et al. | |
| 2012/0141260 | A1 | 6/2012 | Burdgick et al. | |
| 2015/0118041 | A1 | 4/2015 | Fitts et al. | |
| 2017/0292391 | A1 | 10/2017 | Burdgick et al. | |

FOREIGN PATENT DOCUMENTS

| | | | |
|---|---|---|---|
| JP | 48-033906 | U | 4/1973 |
| JP | 60-095103 | A | 5/1985 |
| JP | 64-006301 | A | 1/1989 |
| JP | 64-073106 | A | 3/1989 |
| JP | 02-027102 | A | 1/1990 |
| JP | 02-248603 | A | 10/1990 |
| JP | 11-013409 | A | 1/1999 |
| JP | 2003-097218 | A | 4/2003 |
| JP | 2004-036546 | A | 2/2004 |
| JP | 2007-107467 | A | 4/2007 |
| JP | 2010-209915 | A | 9/2010 |
| JP | 2012-117530 | A | 6/2012 |
| JP | 5100886 | B2 | 12/2012 |
| JP | 2014-047668 | A | 3/2014 |
| JP | 2015-086876 | A | 5/2015 |

OTHER PUBLICATIONS

Office Action dated Jul. 6, 2021, issued in counterpart JP Application No. 2018-036496, with English Translation. (13 pages).

* cited by examiner

VANE SEGMENT AND STEAM TURBINE COMPRISING SAME

TECHNICAL FIELD

The present invention relates to a vane segment including a plurality of vanes and a steam turbine including the vane segment.

This application claims priority based on Japanese Patent Application No. 2018-036496 filed in Japan on Mar. 1, 2018, of which the contents are incorporated herein by reference.

BACKGROUND ART

A steam turbine includes a rotor that rotates about a rotational axis, a casing that covers the rotor, and a plurality of vane segments. The rotor includes a rotor shaft extending in an axial direction parallel to the rotational axis, and a plurality of rotor blade rows fixed to the outer circumference of the rotor shaft and aligned in an axial direction. Each of the rotor blade rows includes a plurality of rotor blades aligned in the circumferential direction with respect to the rotational axis. Vane rows are disposed at a position on the upstream side of each of the rotor blade rows. Each vane row includes a plurality of vanes aligned in the circumferential direction. The vane segment includes a blade ring extending in the circumferential direction and a plurality of vanes disposed on the radial direction inner side of the blade ring. On the blade ring, blade ring grooves depressed from the radial direction inner side toward the radial direction outer side and extending in the circumferential direction are formed. Outer shrouds of the plurality of vanes fit into the blade ring grooves of the blade ring. This blade ring is fixed to a portion of the radial direction inner side of the casing.

Specific structures of this vane segment are disclosed in, for example, Patent Document 1 below. The blade ring grooves of the vane segment include a pair of groove side surfaces that face each other in the axial direction, a groove bottom surface that connects ends on the radial direction outer side of the pair of groove side surfaces, and a convex portion protruding from each of the pair of groove side surfaces. An engagement groove that enters the convex portion of the blade ring groove is formed on the outer shroud of the vane. A leaf spring is disposed between the groove bottom surface of the blade ring groove and the outer circumferential surface of the outer shroud on the vane.

In this vane segment, the connectability between the convex portion of the blade ring groove and the engagement groove of the outer shroud is enhanced by pressing the outer shroud within the blade ring groove inward in the radial direction from the leaf spring in the blade ring groove.

CITATION LIST

Patent Literature

Patent Document 1: JP 2007-107467

SUMMARY OF INVENTION

Technical Problem

In the vane segment described in Patent Document 1, a jig or the like need to be used to collapse the leaf spring every time the outer shroud of one vane is placed in the blade ring groove of the blade ring. As a result, there is a problem in that the assembly man-hours increase for the vane segment. In this vane segment, there is also a problem that the vanes will be rattling against the blade ring in a relationship where the vanes are pressed inward in the radial direction by the leaf springs. In particular, when the leaf springs deteriorate, this tendency becomes stronger.

Therefore, an object of the present invention is to provide a vane segment and a steam turbine including the vane segment that can securely attach vanes to a blade ring and can reduce assembly man-hours.

Solution to Problem

An aspect of the present invention for solving the above-described problem is a vane segment including a blade ring extending in a circumferential direction with respect to an axis, a plurality of vanes attached on a radial direction inner side with respect to the axis of the blade ring and aligned in the circumferential direction, and a caulking member configured to constrain relative movement of the plurality of vanes with respect to the blade ring. Each of the plurality of vanes forms a blade shape and includes a blade body extending in a radial direction with respect to the axis, and an outer shroud formed on a radial direction outer side with respect to the axis of the blade body. The outer shroud includes a first end surface, a second end surface, an outer circumferential surface, and an engagement groove. The first end surface faces a first side in an axial direction in which the axis extends. The second end surface faces a second side opposite to the first side in the axial direction. The outer circumferential surface faces the radial direction outer side and connects an end on the radial direction outer side of the first end surface and an end on the radial direction outer side of the second end surface. The engagement groove is recessed from the second end surface to the first side and extends in the circumferential direction. The blade ring includes a gas path surface, a blade ring groove, and a storage space forming portion. The gas path surface faces the radial direction inner side and extends in the circumferential direction. The blade ring groove is recessed from the gas path surface toward the radial direction outer side and extends in the circumferential direction, into which each of the outer shrouds of the plurality of vanes enters. The storage space forming portion includes a surface forming a storage space that cooperates with the outer shrouds of the plurality of vanes into which the caulking member enters and opening in the radial direction inner side. The blade ring groove includes a first groove side surface, a second groove side surface, a groove bottom surface, and a convex portion. The first groove side surface faces the second side, extends in the circumferential direction, and faces each of the first end surfaces of the outer shrouds of the plurality of vanes. The second groove side surface faces the first side, extends in the circumferential direction, and faces each of the second end surfaces of the outer shrouds of the plurality of vanes. The groove bottom surface faces the radial direction inner side, extends in the circumferential direction, connects the first groove side surface and the second groove side surface, and faces each of the outer circumferential surfaces of the outer shrouds of the plurality of vanes. The convex portion projects from the second groove side surface to the first side, extends in the circumferential direction, and fits into each of the engagement grooves of the outer shrouds in the plurality of vanes. The storage space forming portion is connected to an end on the radial direction inner side of the first groove side surface. The caulking member extends in the circumferential direction, is accommodated in the storage space, contacts the surface of the storage space forming portion, contacts each of the outer shrouds of the plurality of vanes, and is exposed from the opening of the storage space.

In the present aspect, in the portion on the second side of the outer shroud, the convex portion of the blade ring groove fits into the engagement groove of the outer shroud, and relative movement in the radial direction with respect to the blade ring of the outer shroud is constrained. In the portion on the first side of the outer shroud, the caulking member accommodated in the storage space contacts with the surface of the outer shroud and the surface of the blade ring that form the storage space, and relative movement in the radial direction with respect to the blade ring of the outer shroud is constrained. Thus, in the present aspect, the vanes can be securely attached to the blade ring.

In the assembly of the vane segment of the present aspect, first, a plurality of outer shrouds are disposed in the blade ring groove, and one caulking member is disposed in the storage space. Next, a portion of the caulking member exposed from the opening of the storage space, the portion being adjacent to the outer shrouds of the plurality of vanes aligned in the circumferential direction is hit with a tool such as a hammer. Thus, in the present aspect, each time the outer shroud of one vane is inserted in the blade ring groove, the operation of inserting the caulking member and hitting the caulking member and the operation of crushing the leaf spring using a jig or the like as in the technique described in Patent Document 1 can be omitted. Thus, in the present aspect, it is possible to reduce man-hours for the assembly of the vane segments.

In the vane segment, the outer shroud may include a contact inner circumferential surface that faces the radial direction inner side and extends from an end on the radial direction inner side of the first end surface to the second side, and the storage space forming portion may include a space bottom surface and a space side surface. The space bottom surface faces the radial direction inner side, extends in the circumferential direction, and extends from an end on the radial direction inner side of the first groove side surface to the first side. The space side surface is located on the radial direction inner side from the space bottom surface, faces the second side, and extends in the radial direction and the circumferential direction. An end on the radial direction inner side of the space side surface forms a part of an edge on the opening of the storage space. The caulking member contacts the space bottom surface and the space side surface, and contacts each of the contact inner circumferential surfaces of the outer shrouds of the plurality of vanes.

In the present aspect, in the portion on the first side of the outer shroud, the caulking member accommodated in the storage space contacts the space bottom surface and the space side surface of the blade ring, and contacts the contact inner circumferential surfaces of the outer shrouds of the plurality of vanes. Therefore, in the present aspect, in the portion on the first side of the outer shroud, the outer shroud is not relatively movable in the radial direction with respect to the blade ring.

In the vane segment in which the storage space forming portion includes the space base face, the storage space forming portion may include a space back surface and a space bottom facing surface. The space back surface faces the second side, extends in the circumferential direction, and extends to the radial direction inner side from an end on the first side of the space bottom surface. The space bottom facing surface faces the radial direction outer side, extends in the circumferential direction, extends from an end on the radial direction inner side of the space back surface to the second side, and faces the space bottom surface in the radial direction. The space side surface extends from an end on the second side of the space bottom facing surface to the radial direction inner side, and a cross-sectional shape of the storage space in a plane perpendicular to the circumferential direction forms an L shape. A cross-sectional shape of the caulking member in the plane perpendicular to the circumferential direction forms an L shape so as to fit within the storage space.

In the present aspect, because the cross-sectional shape of the storage space forms an L shape, and the cross-sectional shape of the caulking member accommodated in the storage space also forms an L shape, it is possible to prevent loosening of the caulking member and slipping of the caulking member from the storage space.

In any one of the vane segments described above, one end of both ends of the blade body in the axial direction may form a front edge, another end may form a back edge, the first side may be on an axial upstream side on which the frond edge is present with respect to the back edge in the axial direction, and the second side may be on an axial downstream side on which the back edge is present with respect to the front edge in the axial direction.

A force toward the axial downstream side acts on the blade body of the vanes by steam. In the present aspect, the caulking member is disposed on the axial upstream side than the outer shroud of the vane. Thus, in the present aspect, it is possible to minimize deformation of the caulking member due to the vanes on which a force to the axial downstream side acts.

In any one of the vane segments described above, where the storage space forming portion includes the space bottom surface, one end of both ends of the blade body in the axial direction may form a front edge, another end may form a back edge, the first side may be on an axial upstream side on which the frond edge is present with respect to the back edge in the axial direction, the second side may be on an axial downstream side on which the back edge is present with respect to the front edge in the axial direction, and the space bottom surface of the blade ring may be located on the radial direction inner side from the convex portion of the blade ring.

The portion on the radial direction outer side of the vane is supported by the blade ring, and the portion on the radial direction inner side is a free end. Therefore, when a force acts on the blade body of the vane to the axial downstream side by steam, a moment is applied to the vane by which the portion on the radial direction inner side of the vane is intended to rotate on the basis of the portion on the radial direction outer side of the vane. In other words, a moment is applied to the vane by which the portion on the axial upstream side of the outer shroud is intended to move to the radial direction inner side and the portion on the axial downstream side of the outer shroud is intended to move to the radial direction outer side. In the present aspect, the caulking member restricting the movement of the portion on the axial upstream side of the outer shroud in the radial direction is disposed on the radial direction inner side from the convex portion of the blade ring groove that restricts the movement of the portion on the axial downstream side of the outer shroud in the radial direction. Therefore, in the present aspect, a moment acting on the vane can be effectively counteracted.

In any one of the above-described vane segments, where the storage space forming portion includes the space bottom surface, a distance in the radial direction from the groove bottom surface to the space bottom surface of the blade ring may correspond to the distance in the radial direction from the outer circumferential surface of the outer shroud to the contact inner circumferential surface of the outer shroud.

In the present aspect, when the outer shroud is accommodated in the blade ring groove, the space bottom surface of the blade ring and the contact inner circumferential surface of the outer shroud are substantially in the same plane. As a result, a surface of the caulking member contacting the space bottom surface of the blade ring and the contact inner circumferential surface of the outer shroud can be made in the same plane, and the shape of the caulking member can be simplified.

Any one of the vane segments described above may include a first restraining member configured to restrain relative movement in the circumferential direction with respect to the blade ring of the outer shroud of a vane located closest to one side in the circumferential direction among the plurality of vanes aligned in the circumferential direction and a second restraining member configured to restrain relative movement in the circumferential direction with respect to the blade ring of the outer shroud of a vane located closest to another side in the circumferential direction among the plurality of vanes aligned in the circumferential direction.

In an aspect of the present invention for solving the above-described problem, a steam turbine includes any one of the above-described vane segments, a rotor configured to rotate about the axis, and a casing configured to cover the vane segments and the rotor.

Advantageous Effect of Invention

In the vane segments according to an aspect of the present invention, it is possible to securely attach the vanes to the blade ring, thereby reducing assembly man-hours.

DESCRIPTION OF EMBODIMENTS

The following describes in detail an embodiment of a steam turbine according to the present invention, with reference to FIGS. 1 to 8.

Figure 1:
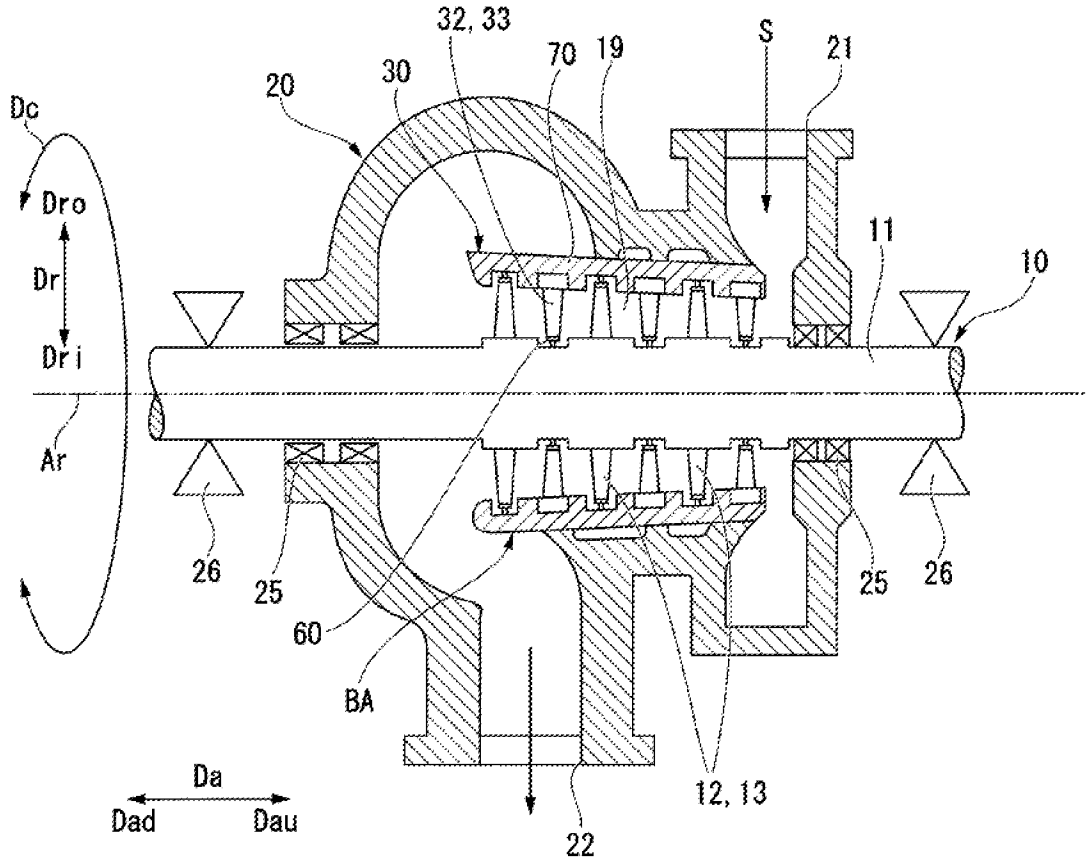
FIG. 1 is a schematic cross-sectional diagram illustrating a steam turbine according to one embodiment of the present invention.

As illustrated in FIG. 1, a steam turbine of the present embodiment includes a rotor 10 that rotates about an axis Ar, a casing, 20 that covers an outer circumferential side of the rotor 10, a vane assembly BA, an axial seal device 25, and a bearing 26. Note that, in the following, a direction in which the axis Ar extends is referred to as an axial direction Da, a circumferential direction around this axis Ar is simply referred to as a circumferential direction Dc, and a direction orthogonal to the axis Ar is referred to as a radial direction Dr. Furthermore, one side in the axial direction Da is an axial upstream side (first side) Dau, and the other side in the axial direction Da is an axial downstream side (second side) Dad. The direction toward the axis Ar in the radial direction Dr is referred to as a radial direction inner side Dri, and the opposite direction as a radial direction outer side Dro.

The rotor 10 includes a rotor shaft 11 that is centered around the axis Ar and extends in the axial direction Da, and a plurality of rotor blade rows 12 attached to this rotor shaft 11. The plurality of rotor blade rows 12 are aligned in the axial direction Da. Each of the rotor blade rows 12 includes a plurality of rotor blades 13 aligned in the circumferential direction Dc.

The vane assembly BA is annular about the axis Ar. The vane assembly BA includes a plurality of vane rows 32. Each of the plurality of vane rows 32 is disposed on the axial upstream side Dau of the rotor blade row 12 of any one of the plurality of rotor blade rows 12. Each of the vane rows 32 includes a plurality of vanes 33 arranged in the circumferential direction Dc. The annular vane assembly BA is constituted by a plurality of vane segments 30 aligned in the circumferential direction Dc. In other words, the annular vane assembly BA can be divided into a plurality of vane segments 30 for convenience of assembly or the like.

The vane segments 30 include a blade ring 70 extending in the circumferential direction Dc, a plurality of vanes 33 attached on the radial direction inner side Dri of the blade ring 70 and aligned in the circumferential direction Dc, and a seal ring 60 disposed on the radial direction inner side Dri of the plurality of vanes 33. The annular space between the radial direction inner side Dri of the blade ring 70 and the radial direction outer side Dro of the rotor shaft 11 forms a steam flow path 19 through which steam S flows.

The casing 20 covers the rotor 10 and the vane segments 30. The casing 20 is formed with an inlet 21 that guides the steam S inside and an outlet 22 that discharges the steam S to the outside. The inlet 21 is located on the axial upstream side Dau from the outlet 22. A portion of the rotor shaft 11 penetrates through the casing 20. The shaft seal device 25 is disposed on a portion of the casing 20 where the rotor shaft 11 penetrates. The bearing 26 rotatably supports both ends of the rotor shaft 11. The blade ring 70 of the vane segment 30 is attached to the portion on the radial direction inner side Dri of the casing 20.

Figure 2:
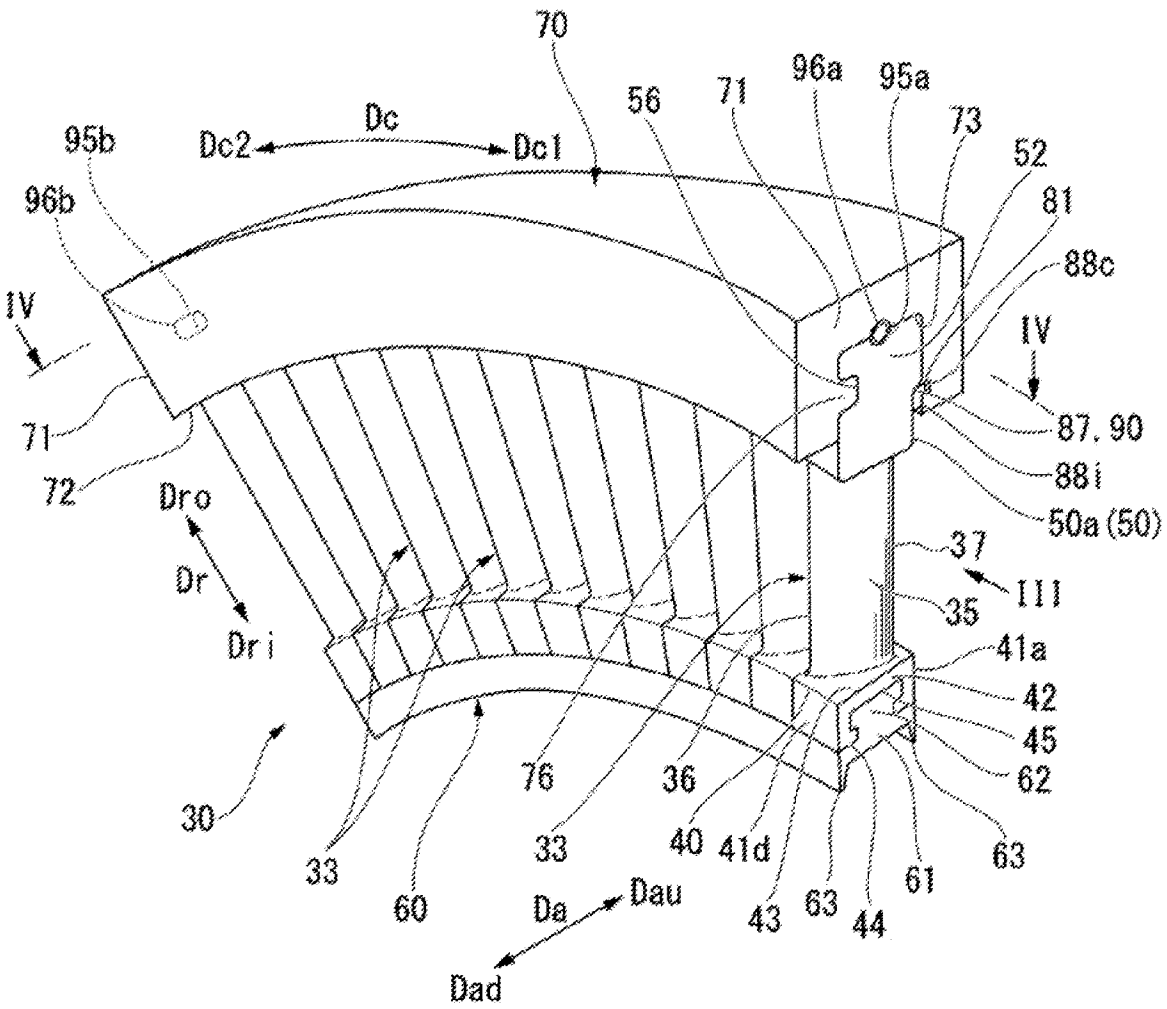
FIG. 2 is a perspective diagram of a vane segment according to one embodiment of the present invention.
Figure 3:
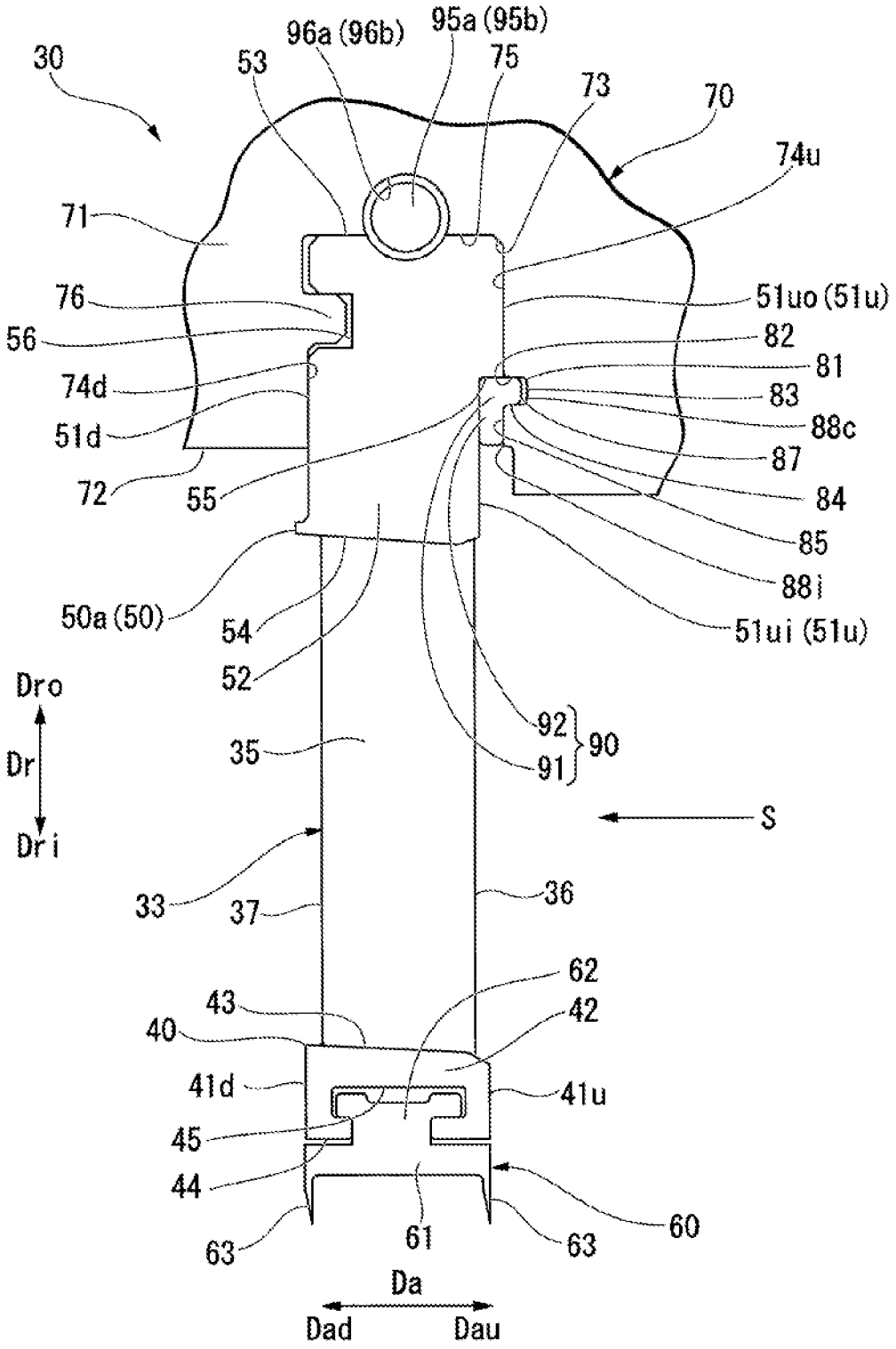
FIG. 3 is a diagram viewing from an arrow III in FIG. 2.

As illustrated in FIGS. 2 and 3, the vane segment 30 further includes a caulking member 90 that constrains movement of the plurality of vanes 33 with respect to the blade ring 70, and two set screws 95*a* and 95*b*.

The vanes 33 that form a part of the vane segment 30 are formed of, for example, a Cr base alloy or a Ni base alloy. Each vane 33 include a blade body 35, an inner shroud 40, and an outer shroud 50. The blade body 35 forms a blade shape and extends in the radial direction Dr. An edge on the axial upstream side Dau of the blade body 35 is a front edge 36. An edge on the axial downstream side Dad of the blade body 35 is a back edge 37. The inner shroud 40 is formed on the radial direction inner side Dri of the blade body 35. The outer shroud 50 is formed on the radial direction outer side Dro of the blade body 35.

The inner shroud 40 includes an upstream end surface 41*u*, a downstream end surface 41*d*, a pair of circumferential direction end surfaces 42, a gas path surface 43, an inner circumferential surface 44, and a ring engagement groove 45. The upstream end surface 41*u* faces the axial upstream side Dau. The downstream end surface 41*d* faces the axial downstream side Dad. This downstream end surface 41*d* is in a back-to-back relationship with the upstream end surface 41*u*. One circumferential direction end surface 42 of the pair of circumferential direction end surfaces 42 faces the one side Dc1 in the circumferential direction Dc, and the other circumferential direction end surface 42 faces the other side Dc2 in the circumferential direction Dc. The gas path surface 43 faces the radial direction outer side Dro and connects the end on the radial direction outer side Dro of the upstream end surface 41*u* and the end on the radial direction outer side Dro of the downstream end surface 41*d*.

The blade body 35 extends from the gas path surface 43 toward the radial direction outer side Dro. The inner circumferential surface 44 faces the radial direction inner side Dri and is in a back-to-back relationship with the gas path surface 43. The ring engagement groove 45 is recessed in the radial direction outer side Dro from the inner circumferential surface 44 and extends in the circumferential direction Dc.

The outer shroud 50 includes an upstream end surface 51*u*, a downstream end surface 51*d*, a pair of circumferential direction end surfaces 52, an outer circumferential surface 53, a gas path surface 54, a contact inner circumferential surface 55, and an engagement groove 56. The upstream end surface 51*u* faces the axial upstream side (first side) Dau. The upstream end surface 51*u* includes an upstream outer end surface (first end surface) 51*uo* and an upstream inner end surface 51*ui*. The upstream outer end surface 51*uo* forms a portion of the radial direction outer side Dro of the upstream end surface 51*u*. The upstream inner end surface 51*ui* forms a portion of the radial direction inner side Dri of the upstream end surface 51*u*. The upstream inner end surface 51*ui* is located on the axial downstream side Dad from the upstream outer end surface 51*uo*. The downstream end surface (second end surface) 51*d* faces the axial downstream side (second side) Dad. This downstream end surface 51*d* is in a back-to-back relationship with the upstream end surface 51*u*. One circumferential direction end surface 52 of the pair of circumferential direction end surfaces 52 faces the one side Dc1 in the circumferential direction Dc, and the other circumferential direction end surface 52 faces the other side Dc2 in the circumferential direction Dc. The outer circumferential surface 53 faces the radial direction outer side Dro and connects the end on the radial direction outer side Dro of the upstream end surface 51*u* and the end on the radial direction outer side Dro of the downstream end surface 51*d*. The gas path surface 54 faces the radial direction inner side Dri and connects the end on the radial direction inner side Dri of the upstream inner end surface 51*ui* and the end in the radial direction inner side Dri of the downstream end surface 51*d*. This gas path surface 54 is in a back-to-back relationship with the outer circumferential surface 53. The blade body 35 extends from the gas path surface 54 toward the radial direction inner side Dri. The contact inner circumferential surface 55 faces the radial direction inner side Dri, extends from the end on the radial direction inner side Dri of the upstream outer end surface (first end surface) 51*uo* to the axial downstream side (second side) Dad, to connect to the end on the radial direction outer side Dro of the upstream inner end surface 51*ui*. The engagement groove 56 is recessed from the downstream end surface 51*d* to the axial upstream side Dau and extends in the circumferential direction Dc. The engagement groove 56 is located on the radial direction outer side Dro of the contact inner circumferential surface 55.

The gas path surface 54 of the outer shroud 50 defines a part of the edge of the radial direction outer side Dro of the steam flow path 19. The gas path surface 43 of the inner shroud 40 that faces the gas path surface 54 of the outer shroud 50 in the radial direction Dr defines a part of the edge of the radial direction inner side Dri of the steam flow path 19.

The seal ring 60, which forms a part of the vane segment 30, includes a ring body 61, an engagement convex portion 62, and a plurality of seal fins 63. The ring body 61 extends in the circumferential direction Dc. The engagement convex portion 62 protrudes from the radial direction outer side Dro of the ring body 61 toward the radial direction outer side Dro and extends in the circumferential direction Dc. The engagement convex portion 62 fits into each of the ring engagement grooves 45 in the inner shrouds 40 of the plurality of vanes 33. The plurality of seal fins 63 protrude from the radial direction inner side Dri of the ring body 61 toward the radial direction inner side Dri. Each seal fin 63 seals a gap between the vane 33 and the rotor shaft 11 in the radial direction Dr.

The blade ring 70 that forms a part of the vane segment 30 includes a pair of circumferential direction end surfaces 71, a gas path surface 72, a blade ring groove 73, and a storage space forming portion 81. One circumferential direction end surface 71 of the pair of circumferential direction end surfaces 71 faces the one side Dc1 in the circumferential direction Dc, and the other circumferential direction end surface 71 faces the other side Dc2 in the circumferential direction Dc. The gas path surface 72 faces the radial direction inner side Dri and extends in the circumferential direction Dc to connect one circumferential direction end surface 71 and the other circumferential direction end surface 71. The blade ring groove 73 is recessed from the gas path surface 72 toward the radial direction outer side Dro and extends in the circumferential direction Dc. The blade ring grooves 73 are open at each of the pair of circumferential direction end surfaces 71. Each of the outer shrouds 50 of the plurality of vanes 33 is inserted into the blade ring groove 73. The storage space forming portion 81 cooperates with the outer shroud 50 of the plurality of vanes 33 to form a storage space 87 in which the caulking member 90 enters and the radial direction inner side Dri is open. The storage space 87 is open to each of the pair of circumferential direction end surfaces 71. Note that in the following, the opening on the radial direction inner side Dri of the storage space 87 is referred to as an inner opening 88*i*, and the opening of the circumferential direction end surface 71 of the storage space 87 is referred to as a circumferential direction opening 88*c*.

The blade ring groove 73 includes an upstream groove side surface (first groove side surface) 74*u*, a downstream groove side surface (second groove side surface) 74*d*, a groove bottom surface 75, and a convex portion 76. The upstream groove side surface 74*u* faces the axial downstream side (second side) Dad and extends in the circumferential direction Dc. The upstream groove side surface 74*u* faces each of the upstream outer end surfaces (first end surfaces) 51*uo* of the outer shrouds 50 of the plurality of vanes 33. The downstream groove side surface 74*d* faces the axial upstream side (first side) Dau and extends in the circumferential direction Dc. The downstream groove side surface 74*d* faces each of the downstream end surfaces (second end surfaces) 51*d* of the outer shrouds 50 of the plurality of vanes 33. The groove bottom surface 75 faces the radial direction inner side Dri, extends in the circumferential direction Dc, and connects the upstream groove side surface (first groove side surface) 74*u* and the downstream groove side surface (second groove side surface) 74*d*. The groove bottom surface 75 faces each of the outer circumferential surfaces 53 of the outer shrouds 50 of the plurality of vanes 33. The convex portion 76 protrudes from the downstream groove side surface (second groove side surface) 74*d* to the axial upstream side (first side) Dau and extends in the circumferential direction Dc. This convex portion 76 fits into each of the engagement grooves 56 in the outer shrouds 50 of the plurality of vanes 33.

The storage space forming portion 81 includes a space bottom surface 82, a space back surface 83, a space base facing surface 84, and a space side surface 85. The space bottom surface 82 faces the radial direction inner side Dri, extends in the circumferential direction Dc, and extends from the end on the radial direction outer side Dro of the upstream groove side surface (first groove side surface) 74*u* to the axial upstream side (first side) Dau. The distance in the radial direction Dr from the groove bottom surface 75 to the space bottom surface 82 is substantially equal to the distance in the radial direction Dr from the outer circumferential surface 53 of the outer shroud 50 to the contact inner circumferential surface 55. The space back surface 83 faces the axial downstream side Dad, extends in the circumferential direction Dc, and extends from the end on the axial upstream side Dau of the space bottom surface 82 to the radial direction inner side Dri. The space bottom facing surface 84 faces the radial direction outer side Dro, extends in the circumferential direction Dc, and extends from the end on the radial direction inner side Dri of the space back surface 83 to the axial downstream side Dad. The space bottom facing surface 84 faces the space bottom surface 82 in the radial direction Dr. The space side surface 85 faces the axial downstream side Dad, extends in the circumferential direction Dc, and extends from the end on the axial downstream side Dad of the space bottom opposing surface 84 to the radial direction inner side Dri. The end on the radial direction inner side Dri the space side surface 85 forms a part of the edge of the inner opening 88*i* of the storage space 87.

The storage space 87 into which the caulking member 90 enters is defined by each surface 82 to 85 of the storage space forming portion 81, the contact inner circumferential surface 55 of the outer shroud 50 that enters the blade ring groove 73, and the upstream inner end surface 51*ui* of the outer shroud 50. The cross-sectional shape of the storage space 87 perpendicular to the circumferential direction Dc forms an L shape.

The caulking member 90 that constitutes a part of the vane segment 30 is formed of a metal that is softer than the vanes 33, for example, stainless steel. The caulking member 90 includes a first piece portion 91 and a second piece portion 92. The first piece portion 91 extends in the axial direction Da and extends in the circumferential direction Dc. The second piece portion 92 extends from the end on the axial downstream side Dad of the first piece portion 91 to the radial direction inner side Dri and extends in the circumferential direction Dc. In other words, the cross-sectional shape of the caulking member 90 perpendicular to the circumferential direction Dc forms an L shape so as to fit in the L-shaped storage space 87.

Figure 4:
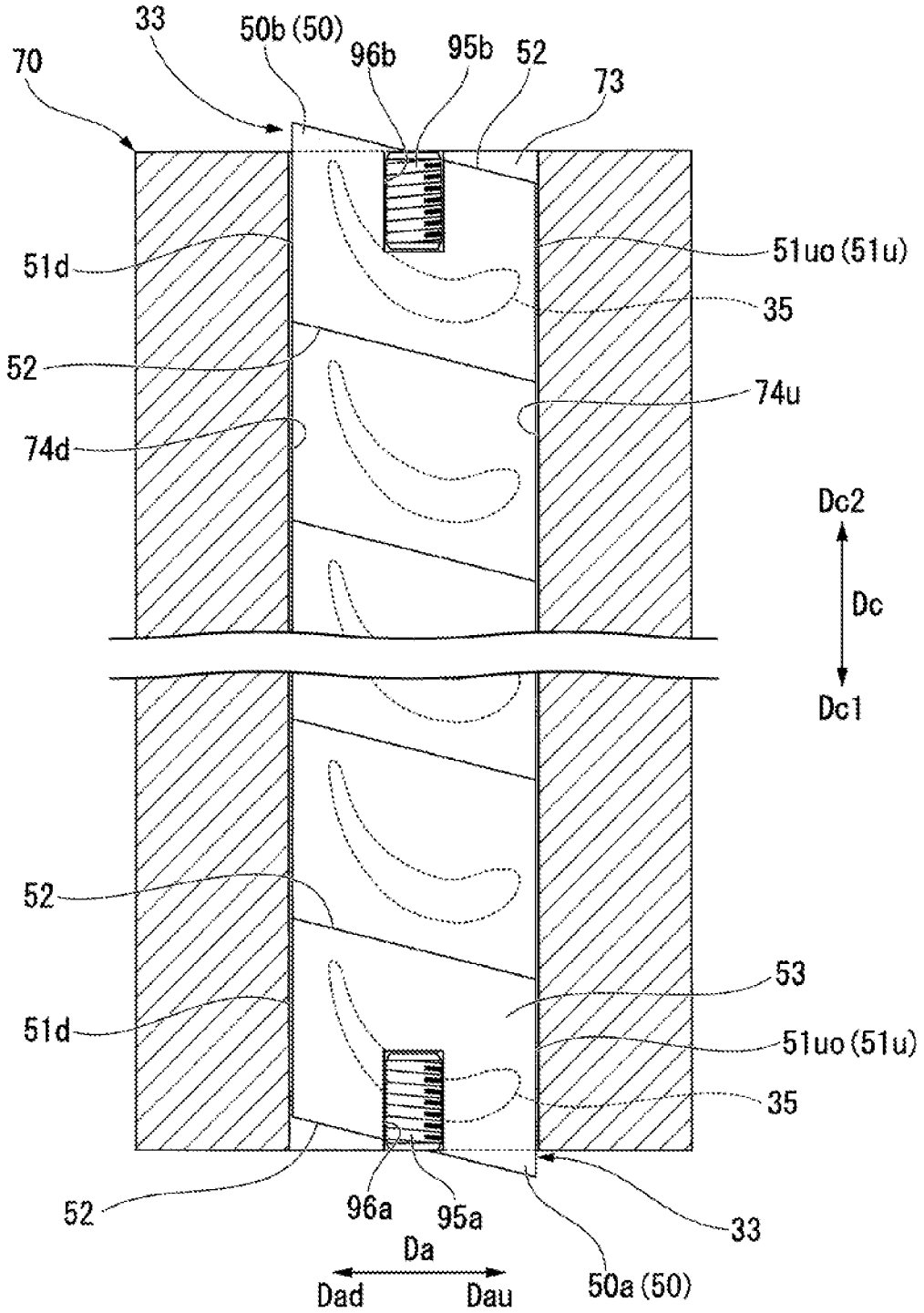
FIG. 4 is a cross-sectional diagram taken along a line IV-IV in FIG. 2.
Figure 5:
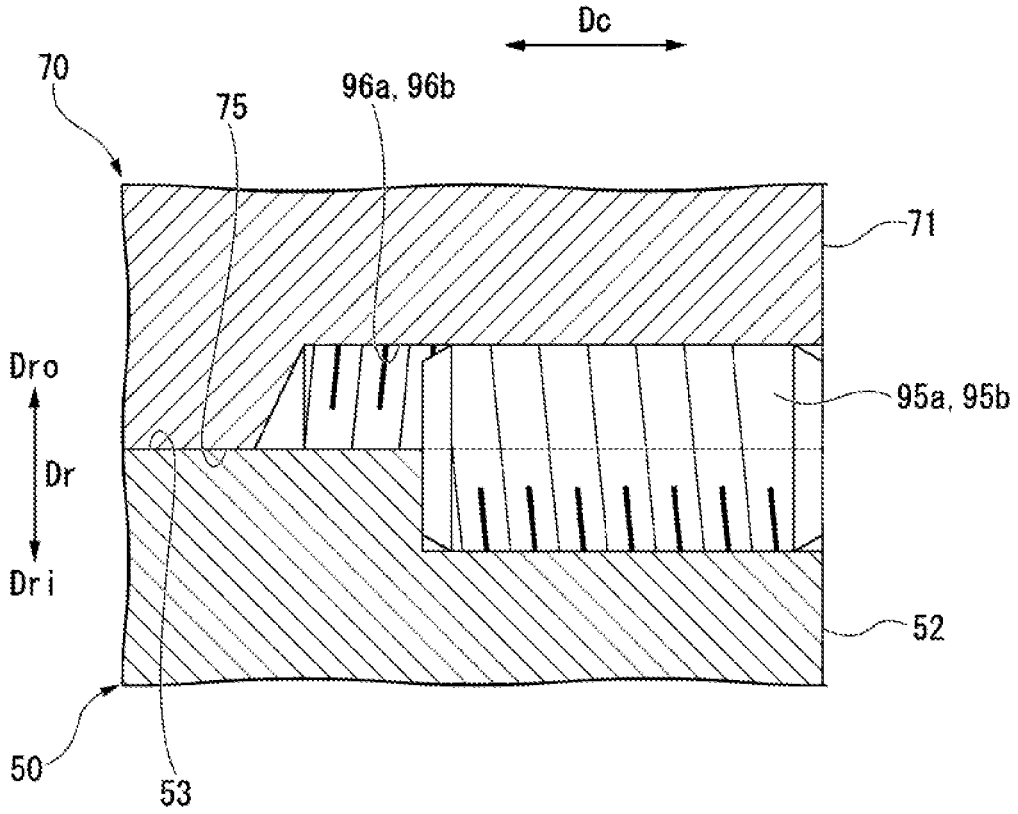
FIG. 5 is a cross-sectional diagram of a vane segment around a set screw according to one embodiment of the present invention.

As illustrated in FIGS. 2 to 4, among the plurality of vanes 33, a first outer shroud 50*a*, which is the outer shroud 50 of the vane 33 located closest to the one side Dc1 in the circumferential direction Dc, and the blade ring 70 are formed with a first screw hole 96*a* across the first outer shroud 50*a* and the blade ring 70. As illustrated in FIG. 5, the first screw hole 96*a* is recessed from the circumferential direction end surface 71 on the one side Dc1 of the pair of circumferential direction end surfaces 71 of the blade ring 70 and the circumferential direction end surface 52 on the one side Dc1 of the pair of circumferential direction end surfaces 52 of the first outer shroud 50*a* toward the other side Dc2 of the circumferential direction Dc. In this first screw hole 96*a*, female threads are formed in the portion formed by the blade ring 70. On the other hand, in this first screw hole 96*a*, female threads are not formed in the portion formed by the first outer shroud 50*a*.

Among the plurality of vanes 33, a second outer shroud 50*b*, which is the outer shroud 50 of the vane 33 located closest to the other side Dc2 in the circumferential direction Dc, and the blade ring 70 are formed with a second screw hole 96*b* across the second outer shroud 50*b* and the blade ring 70. The second screw hole 96*b* is recessed from the circumferential direction end surface 71 on the other side Dc2 of the pair of circumferential direction end surfaces 71 of the blade ring 70 and the circumferential direction end surface 52 on the other side Dc2 of the pair of circumferential direction end surfaces 52 of the second outer shroud 50*b* toward the one side Dc1 in the circumferential direction Dc. In this second screw hole 96*b*, female threads are formed in the portion formed by the blade ring 70. On the other hand, in this second screw hole 96*b*, female threads are not formed in the portion formed by the second outer shroud 50*b*.

The first set screw (first constraint member) 95*a* of the two set screws 95*a* and 95*b* constituting a part of the vane segment 30 can be screwed into the first screw hole 96*a*. The second set screw (second constraint member) 95*b* of the two set screws 95*a* and 95*b* can be screwed into the second screw hole 96*b*. Note that the first screw hole 96*a* and the second screw hole 96*b* have the same shape and the same size. The first set screw 95*a* and the second set screw 95*b* have the same shape and the same size.

Next, an assembly method of the vane segment 30 described above will be described.

In the assembly of the vane segment 30, the steps of attaching each of the inner shrouds 40 of the plurality of vanes 33 to the seal ring 60 and attaching each of the outer shrouds 50 of the plurality of vanes 33 to the blade ring 70 are performed.

Figure 6:
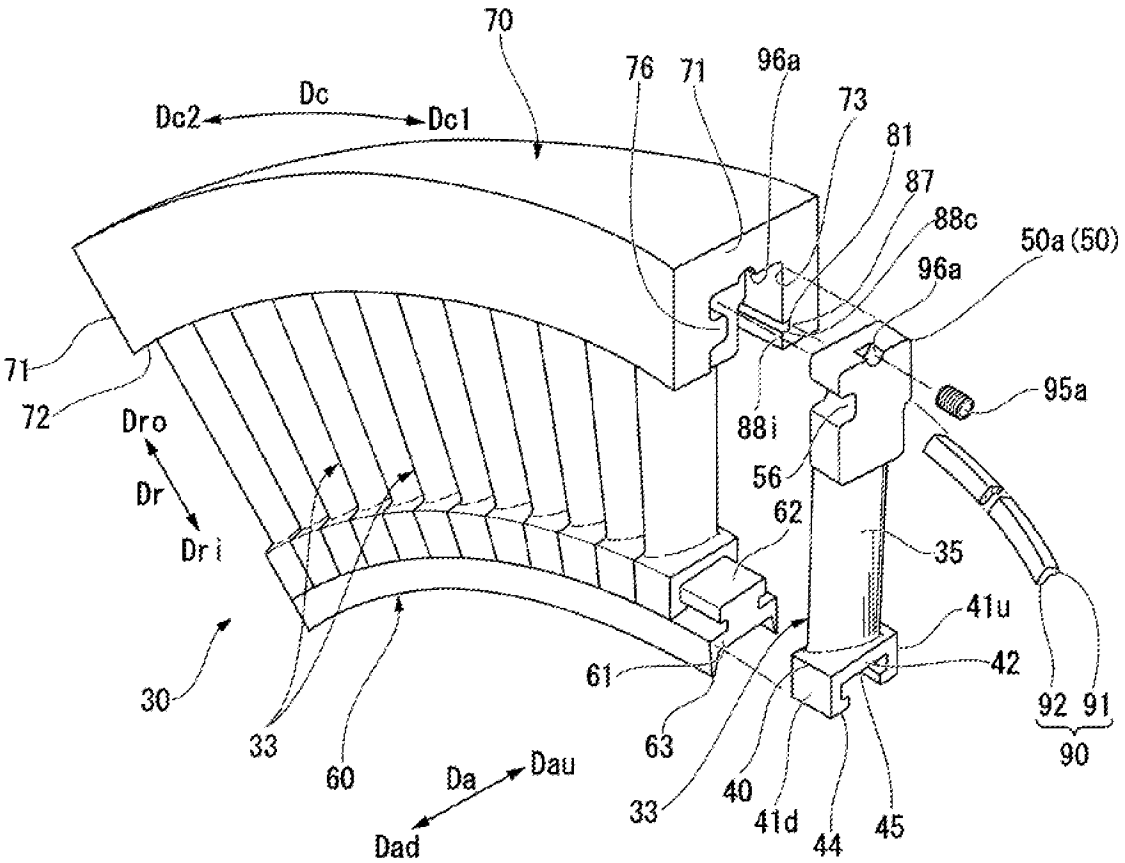
FIG. 6 is an exploded perspective diagram of the vane segment according to the embodiment of the present invention.

In the step of attaching each of the outer shrouds 50 of the plurality of vanes 33 to the blade ring 70, first, as illustrated in FIG. 6, the outer shrouds 50 of the plurality of vanes 33 are sequentially inserted in the blade ring grooves 73 of the blade ring 70. At this time, the outer shroud 50 is inserted into the blade ring groove 73 from the opening of the circumferential direction end surface 71 of the blade ring groove 73. When the outer shroud 50 enters the blade ring groove 73, the convex portion 76 of the blade ring groove 73 fits into the engagement groove 56 of the outer shroud 50.

Next, the caulking member 90 is inserted in the storage space 87, which is a gap between the storage space forming portion 81 of the blade ring 70 and the outer shrouds 50 of the plurality of vanes 33. At this time, the caulking member 90 is moved in the circumferential direction Dc, and the caulking member 90 is inserted into the storage space 87 from the circumferential opening 88*c* of the storage space 87.

Figure 7:
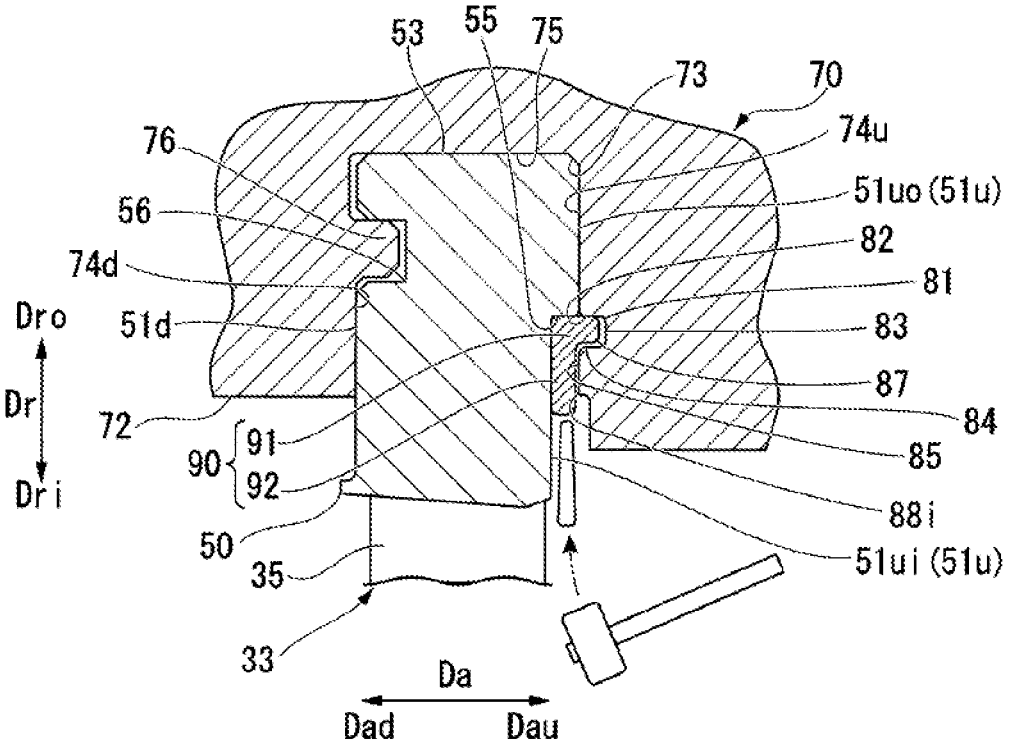
FIG. 7 is a cross-sectional diagram of main portions of the vane segment prior to plastic deformation of a caulking member according to the embodiment of the present invention.
Figure 8:
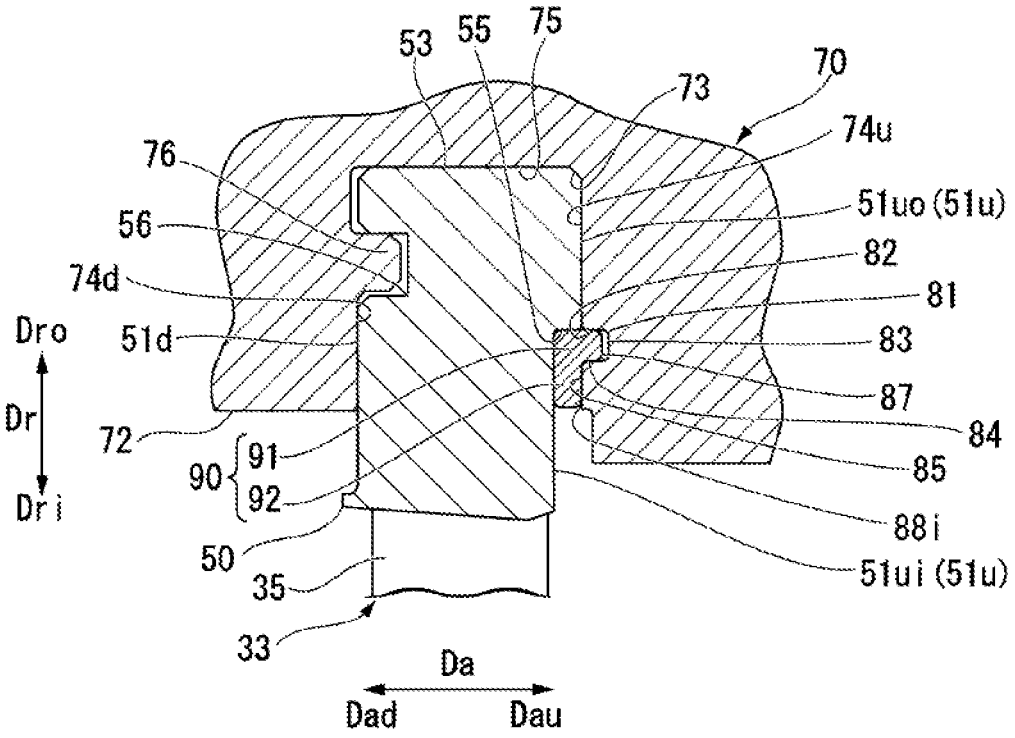
FIG. 8 is a cross-sectional diagram of main portions of the vane segment after plastic deformation of the caulking member according to the embodiment of the present invention.

As illustrated in FIG. 7, at the time when the caulking member 90 is accommodated in the storage space 87, the end on the radial direction inner side Dri of the second piece portion 92 of the caulking member 90 is exposed from the inner opening 88*i* of the storage space 87. In the present embodiment, a portion of the caulking member 90 exposed from the inner opening 88*i* is hit from the radial direction inner side Dri toward the radial direction outer side Dro by using a tool such as a hammer. At this time, in the caulking member 90, most of the portions adjacent to the outer shrouds 50 of the plurality of vanes 33 aligned in the circumferential direction Dc is hit by the tool. As a result, the caulking member 90 plastically deforms, and the first piece portion 91 of the caulking member 90 is in close contact with the inner contact circumferential surface 55 of the plurality of outer shrouds 50, the space bottom surface 82 of the blade ring 70, and the space bottom facing surface 84 of the blade ring 70. Furthermore, the second piece portion 92 of the caulking member 90 is in close contact with the upstream inner end surface 51*ui* of the plurality of outer shrouds 50 and the space side surface 85 of the blade ring 70. In other words, the plurality of outer shrouds 50 are caulked against the blade ring 70 by the caulking member 90. As a result, the outer shrouds 50 of the plurality of vanes 33 are relatively immovably constrained with respect to the blade ring 70 in the radial direction Dr and the axial direction Da.

Next, as illustrated in FIGS. 4 to 6, the first set screw 95*a* is screwed into the first screw hole 96*a*, and the second set screw 95*b* is screwed into the second screw hole 96*b*. When the first set screw 95*a* is screwed into the first screw hole 96*a*, among the plurality of outer shrouds 50 aligned in the circumferential direction Dc, the first outer shroud 50*a* located closest to the one side Dc1 in the circumferential direction Dc cannot move to the one side Dc1 in the circumferential direction Dc with respect to the blade ring 70. When the second set screw 95*b* is screwed into the second screw hole 96*b*, among the plurality of outer shrouds 50 aligned in the circumferential direction Dc, the second outer shroud 501 located closest to the other side Dc2 in the circumferential direction Dc cannot move to the other side Dc2 in the circumferential direction Dc with respect to the blade ring 70. As a result, the outer shrouds 50 of the plurality of vanes 33 disposed within the blade ring grooves 73 are constrained to be relatively immovable with respect to the blade ring 70 in the circumferential direction Dc.

Here, after the plurality of outer shrouds 50 are caulked to the blade ring 70 by the caulking member 90, the two set screws 95*a* and 95*b* are screwed into the screw holes 96*a* and 96*b*, respectively. However, after the plurality of outer shrouds 50 are inserted in the blade ring groove 73, the plurality of outer shrouds 50 may be screwed with two set screws 95*a* and 95*b* into the screw holes 96*a* and 96*b*, respectively, before being caulked to the blade ring 70 by the caulking member 90.

The assembly of the vane segment 30 is completed as described above.

In the present embodiment, in the portion on the axial downstream side Dad of the outer shroud 50, the convex portion 76 of the blade ring groove 73 fits into the engagement groove 56 of the outer shroud 50, and relative movement of the outer shroud 50 in the radial direction Dr with respect to the blade ring 70 is constrained. In the portion on the axial upstream side Dau of the outer shroud 50, the caulking member 90 accommodated in the storage space 87 contacts the surface of the outer shroud 50 and the surface of the blade ring 70 forming the storage space 87, and relative movement of the outer shroud 50 in the radial direction Dr with respect to the blade ring 70 is constrained. More specifically, in the portion on the axial upstream side Dau of the outer shroud 50, the first piece portion 91 of the caulking member 90 is in close contact with the inner contact circumferential surface 55 of the plurality of outer shrouds 50, the space bottom surface 82 of the blade ring 70, and the space base opposing surface 84 of the blade ring 70, and the outer shroud 50 cannot move relative to the blade ring 70 in the radial direction Dr. Furthermore, in the portion on the axial upstream side Dau of the outer shroud 50, the second piece portion 92 of the caulking member 90 is in close contact with the upstream inner end surface 51*ui* of the plurality of outer shrouds 50 and the space side surface 85 of the blade ring 70, and the outer shroud 50 cannot move relative to the axial direction Da with respect to the blade ring 70. Thus, in the present embodiment, the vanes 33 can be securely attached to the blade ring 70.

In the present embodiment, the cross-sectional shape of the storage space 87 is an L shape, and the cross-sectional shape of the caulking member 90 that fits in the storage space 87 is also an L shape, so it is possible to prevent loosening of the caulking member 90 and slipping of the caulking member 90 from the storage space 87.

A force toward the axial downstream side Dad acts on the blade body 35 of the vane 33 by the steam S. In the present embodiment, the caulking member 90 is disposed on the axial upstream side Dau from the outer shroud 50 of the vane 33. Thus, in the present embodiment, it is possible to minimize deformation of the caulking member 90 formed by a material that is softer than the vane 33 due to the vanes 33 on which a force to the axial downstream side Dad acts.

The portion on the radial direction outer side Dro of the vane 33 is supported by the blade ring 70, and the portion on the radial direction inner side Dri is a free end. Therefore, when a force acts on the blade body 35 of the vane 33 to the axial downstream side Dad, a moment is applied to the vane 33 by which the portion on the radial direction inner side Dro of the vane 33 is intended to rotate on the basis of the portion on the radial direction outer side Dri of the vane 33. In other words, a moment is applied to the vane 33 by which the portion on the axial upstream side Dau of the outer shroud 50 is intended to move to the radial direction inner side Dri and the portion on the axial downstream side Dad of the outer shroud 50 is intended to move to the radial direction outer side Dro. In the present embodiment, the caulking member 90 restricting the movement of the portion on the axial upstream side Dau of the outer shroud 50 in the radial direction Dr is disposed on the radial direction inner side Dri from the convex portion 76 of the blade ring groove 73 that restricts the movement of the portion on the axial downstream side Dad of the outer shroud 50 in the radial direction Dr. Thus, in the present embodiment, a moment acting on the vane 33 can be effectively counteracted.

In the present embodiment, after the plurality of outer shrouds 50 are accommodated in the blade ring groove 73 and one caulking member 90 is accommodated in the storage space 87, the portion of the caulking member 90 adjacent to the outer shrouds 50 of the plurality of vanes 33 aligned in the circumferential direction Dc is hit by a tool such as a hammer, as described above. Thus, in the present embodiment, each time the outer shroud 50 of one vane 33 is inserted in the blade ring groove 73, for example, the operation of inserting the caulking member and hitting the caulking member and the operation of crushing the leaf spring by using a jig or the like as in the technique described in Patent Document 1 can be omitted. Thus, in the present embodiment, it is possible to reduce assembly man-hours of the vane segments 30.

In the present embodiment, the convex portion 76 of the blade ring groove 73 is disposed on the axial downstream side Dad of the outer shroud 50, and the caulking member 90 is disposed on the axial upstream side Dau of the outer shroud 50. However, the caulking member 90 may be disposed on the axial downstream side Dad of the outer shroud 50, and the convex portion 76 of the blade ring groove 73 may be disposed on the axial upstream side Dau of the outer shroud 50. However, in this case, the amount of deformation of the caulking member 90 is greater than that of the present embodiment due to the vanes 33 on which a force toward the axial downstream side Dad acts.

In the present embodiment, the cross-sectional shape of the storage space 87 is an L shape, and the cross-sectional shape of the caulking member 90 that fits in the storage space 87 is also an L shape. However, the cross-sectional shape of the storage space 87 and the cross-sectional shape of the caulking member 90 are not limited to an L shape. For example, the cross-sectional shape of the storage space and the cross-sectional shape of the caulking member may be more complex than an L shape. The cross-sectional shape of the storage space may be a rod shape, and the cross-sectional shape of the caulking member may also be a rod shape. However, when the cross-sectional shape of the storage space and the cross-sectional shape of the caulking member are both rod shapes, loosening of the caulking member and slipping of the caulking member from the blade ring may possibly occur.

INDUSTRIAL APPLICABILITY

According to an aspect of the present invention, it is possible to securely attach the vanes to the blade ring, thereby reducing assembly man-hours.

REFERENCE SIGNS LIST

10 Rotor
11 Rotor shaft
12 Rotor blade row
13 Rotor blade
19 Steam flow path
20 Casing
21 Inlet
22 Outlet
25 Shaft seal device
26 Bearing
30 Vane segment
32 Vane row
33 Vane
35 Blade body
36 Front edge
37 Back edge
40 Inner shroud
41*u* Upstream end surface
41*d* Downstream end surface
42 Circumferential direction end surface
43 Gas path surface
44 Inner circumferential surface
45 Ring engagement groove
50 Outer shroud
50*a* First outer shroud
50*b* Second outer shroud
51*u* Upstream end surface
51*uo* Upstream outer end surface (first end surface)
51*ui* Upstream inner end surface
51*d* Downstream end surface (second end surface)
52 Circumferential direction end surface
53 Outer circumferential surface
54 Gas path surface
55 Contact inner circumferential surface
56 Engagement groove
60 Seal ring
61 Ring body
62 Engagement convex portion
63 Seal fin
70 Blade ring
71 Circumferential direction end surface
72 Gas path surface
73 Blade ring groove
74*u* Upstream groove side surface (first groove side surface)
74*d* Downstream groove side surface (second groove side surface)
75 Groove bottom surface
76 Convex portion
81 Storage space forming portion
82 Space bottom surface
83 Space back surface
84 Space bottom facing surface
85 Space side surface
87 Storage space
88*c* Circumferential direction opening
88*i* Inner opening
90 Caulking member
91 First piece portion
92 Second piece portion
95*a* First set screw (first constraint member)
95*b* Second set screw (second constraint member)
96*a* First screw hole
96*b* Second screw hole
Ar Axis
BA Vane assembly
S steam
Da Axial direction
Dau Axial upstream side (first side)
Dad Axial downstream side (second side)
Dc Circumferential direction
Dc1 One side in circumferential direction
Dc2 Other side in circumferential direction
Dr Radial direction
Dri Radial direction inner side
Dro Radial direction outer side

The invention claimed is:

1. A vane segment of a steam turbine, the vane segment comprising:

a blade ring extending in a circumferential direction with respect to an axis;

a plurality of vanes provided inside the blade ring in a radially inner direction therefrom with respect to the axis and aligned in the circumferential direction; and a caulking member configured to constrain relative movement of the plurality of vanes with respect to the blade ring, wherein each of the plurality of vanes forms a blade shape and includes a blade body extending in a radial direction with respect to the axis, and an outer shroud provided outside the blade body in a radially outer direction therefrom with respect to the axis, the outer shroud includes a first end surface, a second end surface, an outer circumferential surface, and an engagement groove, the first end surface faces a first side in an axial direction in which the axis extends, the second end surface faces a second side opposite to the first side in the axial direction, the outer circumferential surface faces in the radially outer direction and connects a radially outer end of the first end surface and a radially outer end of the second end surface, the engagement groove is recessed from the second end surface to the first side and extends in the circumferential direction, the blade ring includes a gas path surface, a blade ring groove, and a storage space forming portion, the gas path surface faces in the radially inner direction and extends in the circumferential direction, the blade ring groove is recessed in the radially outer direction from the gas path surface and extends in the circumferential direction, into which each of the outer shrouds of the plurality of vanes enters, the storage space forming portion includes a surface forming a storage space in cooperation with the outer shrouds of the plurality of vanes, the storage space accommodating the caulking member and having an opening that opens in the radially inner direction, the blade ring groove includes a first groove side surface, a second groove side surface, a groove bottom surface, and a convex portion, the first groove side surface faces the second side, extends in the circumferential direction, and faces each of the first end surfaces of the outer shrouds of the plurality of vanes, the second groove side surface faces the first side, extends in the circumferential direction, and faces each of the second end surfaces of the outer shrouds of the plurality of vanes, the groove bottom surface faces in the radially inner direction, extends in the circumferential direction, connects the first groove side surface and the second groove side surface, and faces each of the outer circumferential surfaces of the outer shrouds of the plurality of vanes, the convex portion projects from the second groove side surface to the first side, extends in the circumferential direction, and fits into each of the engagement grooves of the outer shrouds in the plurality of vanes, the storage space forming portion is connected to a radially inner end of the first groove side surface, the caulking member extends in the circumferential direction, is accommodated in the storage space, contacts the surface of the storage space forming portion, contacts each of the outer shrouds of the plurality of vanes, and is exposed from the opening of the storage space, relative movement of the outer shroud in the radial direction with respect to the blade ring is constrained by the convex portion on the second side of the outer shroud, relative movement of the outer shroud in the radial direction and the axial direction with respect to the blade ring is constrained by the caulking member on the first side of the outer shroud, the outer shroud includes a contact inner circumferential surface that faces in the radially inner direction and extends from a radially inner end of the first end surface to the second side, and the engagement groove is located further in the radially outer direction with respect to the axis than the contact inner circumferential surface.

2. The vane segment of the steam turbine according to claim 1, wherein the storage space forming portion includes a space bottom surface and a space side surface, the space bottom surface faces in the radially inner direction, extends in the circumferential direction, and extends from the radially inner end of the first groove side surface to the first side, the space side surface is located in the radially inner direction from the space bottom surface, faces the second side, and extends in the radial direction and the circumferential direction, a radially inner end of the space side surface forms a part of an edge on the opening of the storage space, and the caulking member contacts the space bottom surface and the space side surface, and contacts each of the contact inner circumferential surfaces of the outer shrouds of the plurality of vanes.

3. The vane segment of the steam turbine according to claim 2, wherein the storage space forming portion includes a space back surface and a space bottom facing surface, the space back surface faces the second side, extends in the circumferential direction, and extends in the radially inner direction from an end on a first side of the space bottom surface, the space bottom facing surface faces in the radially outer direction, extends in the circumferential direction, extends from a radially inner end of the space back surface to the second side, and faces the space bottom surface in the radial direction, the space side surface extends in the radially inner direction from an end on a second side of the space bottom facing surface, a cross-sectional shape of the storage space in a plane perpendicular to the circumferential direction forms an L shape, and a cross-sectional shape of the caulking member in the plane perpendicular to the circumferential direction forms an L shape to fit within the storage space.

4. The vane segment of the steam turbine according to claim 2, wherein one end of both ends of the blade body in the axial direction forms a front edge, and another end forms a back edge, the first side is on an axial upstream side on which the front edge is present with respect to the back edge in the axial direction, the second side is on an axial downstream side on which the back edge is present with respect to the front edge in the axial direction, and the space bottom surface of the blade ring is located in the radially inner direction from the convex portion of the blade ring.

5. The vane segment of the steam turbine according to claim 2 wherein a distance in the radial direction from the groove bottom surface to the space bottom surface of the blade ring corresponds to the distance in the radial direction from the outer circumferential surface of the outer shroud to the contact inner circumferential surface of the outer shroud.

6. The vane segment of the steam turbine according to claim 1, wherein one end of both ends of the blade body in the axial direction forms a front edge, and another end forms a back edge, the first side is on an axial upstream side on which the front edge is present with respect to the back edge in the axial direction, and the second side is on an axial downstream side on which the back edge is present with respect to the front edge in the axial direction.

7. The vane segment of the steam turbine according to claim 1, comprising:

a first set screw configured to restrain relative movement in the circumferential direction with respect to the blade ring of the outer shroud of a vane located closest to one side in the circumferential direction among the plurality of vanes aligned in the circumferential direction; and a second set screw configured to restrain relative movement in the circumferential direction with respect to the blade ring of the outer shroud of a vane located closest to another side in the circumferential direction among the plurality of vanes aligned in the circumferential direction.

8. A steam turbine comprising:

the vane segment of the steam turbine according to claim 1;

a rotor configured to rotate about the axis; and a casing configured to cover the vane segment and the rotor.

* * * * *